US005243734A

United States Patent [19]

Maurer et al.

[11] Patent Number: 5,243,734

[45] Date of Patent: Sep. 14, 1993

[54] CLEANER CONVERSION VALVE

[75] Inventors: Edgar A. Maurer, Canton; Jeffrey S. Louis, Akron, both of Ohio

[73] Assignee: The Hoover Company, North Canton, Ohio

[21] Appl. No.: 720,017

[22] Filed: Jun. 24, 1991

[51] Int. Cl.[5] ..... A47L 5/32

[52] U.S. Cl. ..... 15/334; 15/331

[58] Field of Search ..... 15/331, 332, 333, 334, 15/337

[56] References Cited

U.S. PATENT DOCUMENTS

| | | | |
|---|---|---|---|
| 1,953,944 | 4/1934 | Becker . | |
| 2,046,684 | 7/1936 | Hoover | 15/334 |
| 2,156,805 | 5/1939 | Dow | 15/334 |
| 2,190,882 | 2/1940 | Pardee . | |
| 2,240,107 | 4/1941 | Wells | 15/331 |
| 2,259,386 | 10/1941 | Luse . | |
| 2,348,861 | 5/1944 | Smellie | 15/331 X |
| 2,372,033 | 3/1945 | Taylor . | |
| 2,677,846 | 5/1954 | Segesman . | |
| 2,730,751 | 1/1956 | Brace . | |
| 4,376,322 | 3/1983 | Lockhart et al. . | |
| 4,472,856 | 9/1984 | Goodin | 15/337 |
| 4,573,236 | 3/1986 | Dyson | 15/333 |
| 4,811,452 | 3/1989 | Sumerau | 15/333 |
| 4,951,346 | 8/1990 | Salmon | 15/331 X |

FOREIGN PATENT DOCUMENTS 2047081 11/1980 United Kingdom .

*Primary Examiner*—Chris K. Moore

[57] ABSTRACT

A cleaner is disclosed having both above and on floor operation where conversion to off the floor operation is occasioned by a manually operated conversion valve. It is latched in its converted position by manipulation of the cleaner handle to upright stored position prior to its manual operation.

17 Claims, 3 Drawing Sheets

FIG.-5
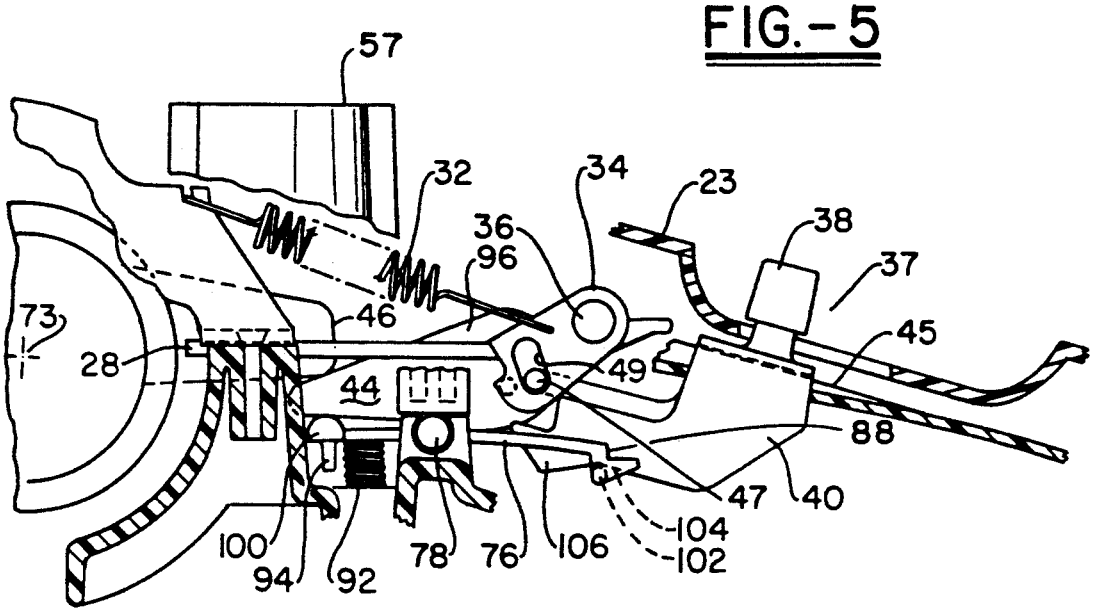
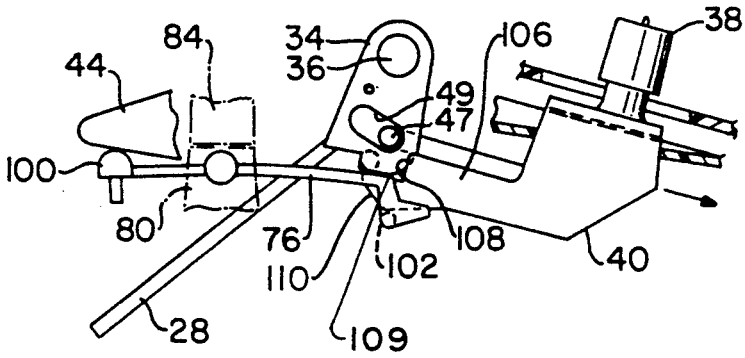
FIG.-6
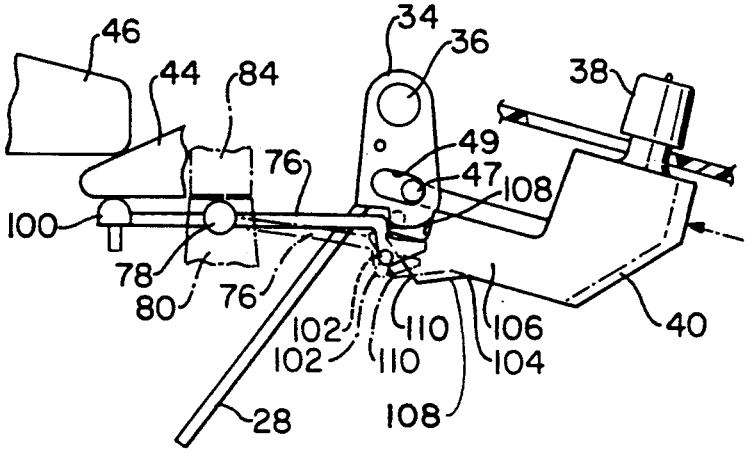
FIG.-7

CLEANER CONVERSION VALVE

BACKGROUND OF THE INVENTION

1. Field of the Invention

This invention relates to vacuum cleaners and, more specifically, relates to a conversion valve for an upright vacuum cleaner.

2. Summary of the Prior Art

The use of conversion valve arrangements in upright vacuum cleaners is old and well known. Their use is also known where provision is made for lifting of the cleaner's rotating agitator off its cleaning surface during conversion. Automatic cleaner conversion is also known to be occasioned by movement of the cleaner handle to an upright stored position, with this movement driving the conversion valve to converted hose operating position. At least one prior art cleaner having this feature also includes automatic height adjustment of the cleaner nozzle to remove the agitator from the surface to be cleaned.

However, deliberate manual actuation of a cleaner conversion valve by an operating knob or the like is obviously also desirable. But this manual actuation of the valve should be accomplished only along with necessary height adjustment of the nozzle. One way of accomplishing these two requirements is the use of a manually actuated converter valve which is latched in converted position, normally by prior situation of the cleaner handle in an upright, stored position. This position of the handle, as is old in the art, also raises the cleaner agitator from engagement with the surface being cleaned.

According, it is an object of the invention to provide a cleaner in which the movement of the cleaner handle to an upright storage position provides for setting of the latching means for a conversion valve when moved to its converted position.

It is an additional object of the invention to provide an improved manually actuated conversion valve for use with an upright cleaner.

It is a still further object of the invention to provide a latching arrangement operative between the handle and conversion valve with an override permitting the conversion valve to be placed in the on the floor, agitator mode after latched positioning of it in the off the floor, hose mode.

It is an even additional object of the invention to provide a latch arrangement operative between the handle and conversion valve for latching the valve in an off the floor, hose mode when the cleaner handle is moved later to its operating position.

It is an even further object of the invention to provide an improved cleaner conversion valve and latching arrangement in an upright cleaner.

SUMMARY OF THE INVENTION

The invention is provided in an upright cleaner having a handle pivotal relative to the cleaner main body. This handle includes an actuating tab which engages and drives a nozzle lifting link when the cleaner handle is put in upright storage position. The lifting link, as is conventional, is located to engage the cleaner nozzle which mounts the rotating agitator to lift this nozzle and disengage the rotating agitator from its cleaning surface.

A manually actuated pivoting, swinging valve plate is disposed in the suction duct leading from the agitator chamber to the fan chamber of the cleaner. This closes against the agitator side of the duct to provide conversion and full suction to an attached suction hose. Manual actuation is through a finger operated reciprocating slide that cammingly drives a pivoting valve lever which is integrally attached to the valve plate. The valve plate is continuously urged to an open nonconverted position by a tension spring attached to the main body and pivoting valve lever.

A latching lever is also pivotally attached to the main body intermediate its ends so that the nozzle lifting link may engage one of its ends to pivot its other end into notched engagement with the pivoted valve lever when the valve lever and valve plate are moved to converted position.

Override of the latched position of the valve lever to place the valve in an unconverted position is obtained by the finger operated slide. It includes a thrust finger extending towards the conversion valve which has a pair of angled cam surfaces that are capable of engaging a pin mounted with the latching lever. By camming against this pin, the thrust finger bendingly cams one end of the latching lever to a clearance position so that the finger operated slide may move the valve plate away from a closed position over the agitator duct.

BRIEF DESCRIPTION OF THE DRAWINGS

Reference may now be had to the accompanying Drawings for a better understanding of the invention, both as to its organization and function, with the illustration being of a preferred embodiment, but being only exemplary, and in which:

FIG. 5 is a similar view with the valve plate in open, unconverted position but with the handle in storage position;

FIG. 6 is a similar view but showing only the major valve parts and depicting the overriding movement of the valve structure to closed, converted position with the handle in upright, stored position, and FIG. 7 is a similar view but illustrates overriding movement of the valve structure to open, unconverted position with the handle in upright, storage position.

DETAILED DESCRIPTION OF THE INVENTION

Figure 1:
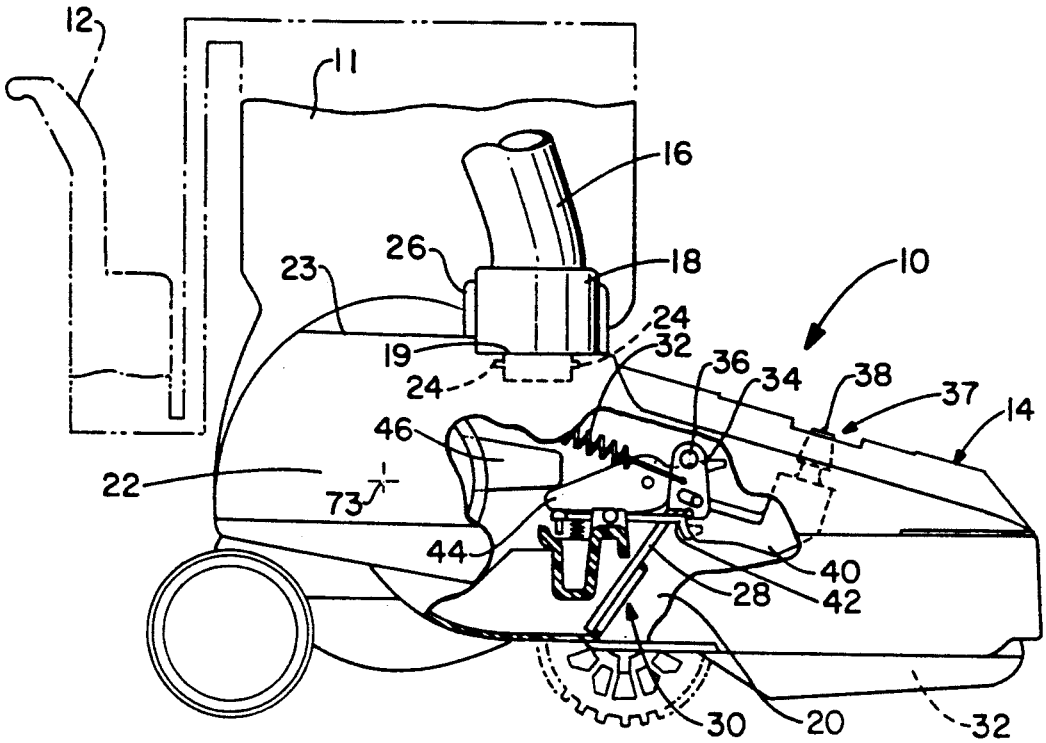
FIG. 1 is a partial elevational view of a cleaner incorporating the invention with its handle in stored position and certain parts emphasized.

There is shown in FIG. 1, a vacuum cleaner 10 having a hard bag 11 including a hard bag handle 12 conventionally trunnioned to a main nozzle body 14. Such a cleaner, for example, is shown in U.S. Pat. No. 4,171,554, issued Oct. 23, 1979 and owned by a common assignee.

Since the vacuum cleaner 10, in this view, is shown in converted position, a conversion hose 16 is fixedly attached to the main nozzle body 14 by a fitting 18 that communicates, through an opening 19 in a hood 23 of the main body nozzle 14, with a suction duct 20 formed in a side portion 22 of main body nozzle body 14. This fitting is maintained in mounted condition, e.g., by bayonet projections 24, 24 integral with fitting 18. During normal floor operation, a hose door 26, hinged to hood 23 closes over opening 19 to seal suction duct 20 at opening 19 although the hose may remain attached with the cleaner 10 in a non-converted position. This door is shown in open, converted position in FIG. 1. It should be clear that a permanent plug-in hose could also be utilized as is old in the art.

A valve door 28 of a conversion valve 30 is disposed in duct 20 to open or close off fluid communication to a conventional agitator chamber 32. This valve door is constantly spring-urged to open unconverted position by a tension spring 32 acting in tension against a valve cam link 34 disposed inwardly of the valve door. The valve cam link 34 is fixed to the valve door 28 through an integral pintle pin 36 attached to both of them (the door is bent to permit this attachment) so that they are axially spaced so that the valve door 28 can swing upwardly and downwardly within suction duct 20 and the valve cam link 34 can similarly swing behind the duct 20.

A manual valve control knob 38 of a manual actuating means 37 is fixedly attached to a rearwardly extending projecting portion 40 which moves the valve cam link 34. It also serves as a portion of a latching means (and an unlatching means as later to be described) for conversion valve 30 through a latching bar 42 engaging with it. This latching bar is moved to active upper position by movement of a handle actuated pivoting lever 44 engageable by a fixed tab 46 on the hard bag handle 12 when in its upper, stored position. The operation of conversion valve 30 will now be described in more detail in relation to the remaining Figures of the drawings.

Figure 2:
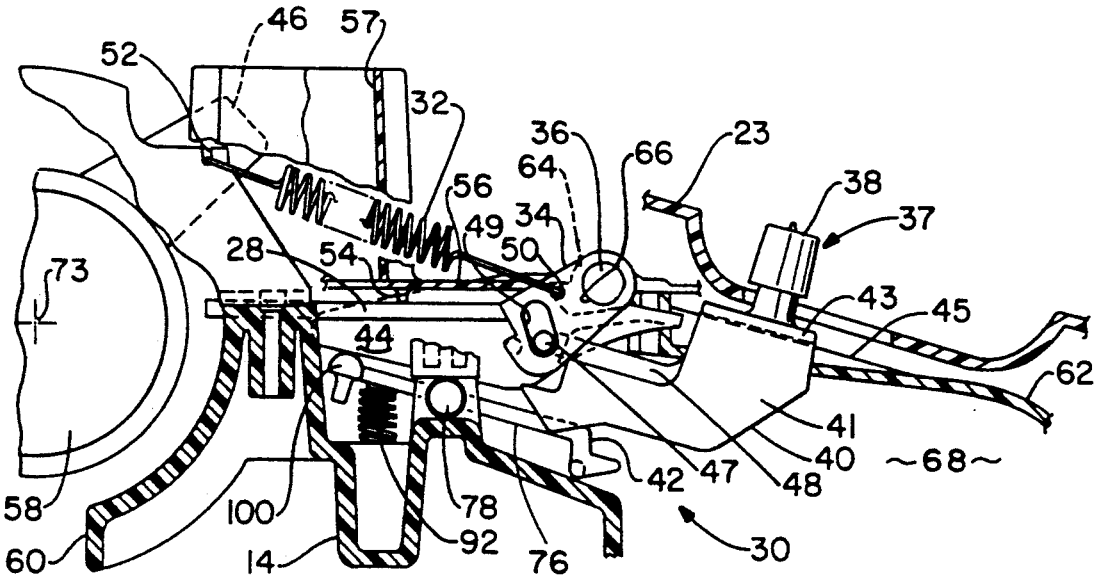
FIG. 2 is a partial cross sectional view of the conversion valve arrangement and surrounding structure with the valve plate in open, unconverted position and showing some of the hidden parts in full for emphasis and taken generally on a medial fore and aft line through the nozzle and looking towards the conversion valve.

In the open position of valve door 28 in FIG. 2 (unconverted), the manual knob 38 is located rectilinearly rearwardly (leftwardly in the FIG. 2 view) relative to the hood 23 of the main nozzle body so that a pin 47 on an upper arm 48 of fixed projection 40 and disposed in a clearance slot 49 in cam link 34 is located sufficiently far rearwardly so as to permit the valve cam link 34 to be situated at its maximum clockwise extent. This places valve door 28 at its upper limit position as urged by tension spring 32. This spring is hooked on its ends and acts through an apertured connection 50 on valve cam link 34 and a notch 52 on main nozzle body 14 so as to constantly urge cam link 34 and attached valve door 28 clockwise.

The valve door 28 is limited in its clockwise swinging motion by stop means 54 located internal to suction duct 20, adjacent the conversion opening 19. This stop is contained on a duct cap 56 which covers the rearward (leftward) portion of duct 20 and thereby also includes a duct communicating bore 57 immediately below the hood opening 19. The valve door 28, then, has no sealing function relative to the opening 19 when abutting the stop means 54, this location only providing an out of the way position for it and thereby relative little obstruction to air flow from the agitator chamber 33 to a motor fan system suction opening 58 disposed downstream of the conversion valve 30.

The suction duct 20 is formed primarily in the main nozzle body bottom plastic casting 60 and includes a full duct at its front (not shown) that has an integral top surface 62 which extends rearwardly to terminate at its connection with the duct cap 56. In this rear area of the suction duct 20 the duct (not shown) is complete except for its top provided by the duct cap 56.

The valve door 28 is, as indicated, situated within the duct 20 to engage the stop 54 in its upward swinging movement. This movement is permitted by the integral pintle formed by the pivot pin 36 which extends transverse to the duct 20 on each of its sides and is captured half in the duct cap 56 by inner and outer half bosses 64, 64 (only one shown) formed in it which extend over mating semi-circular depression 66, 66 (only one shown) in upstanding walls 68, 68 (only the inner shown) in suction duct 20.

Figure 3:
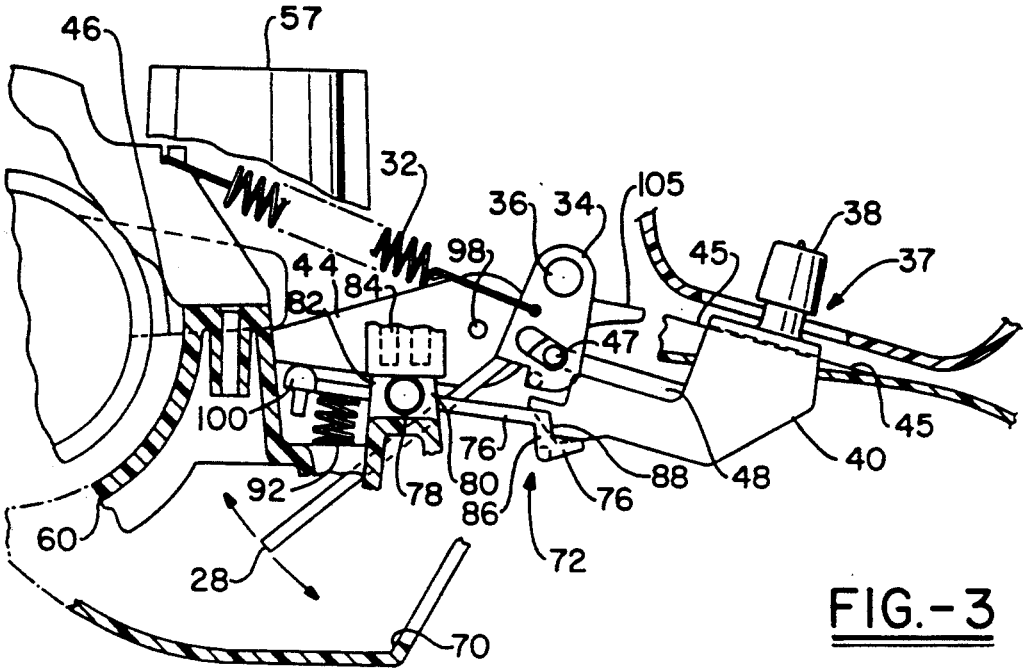
FIG. 3 is a similar view with the valve plate partly closed.
Figure 4:
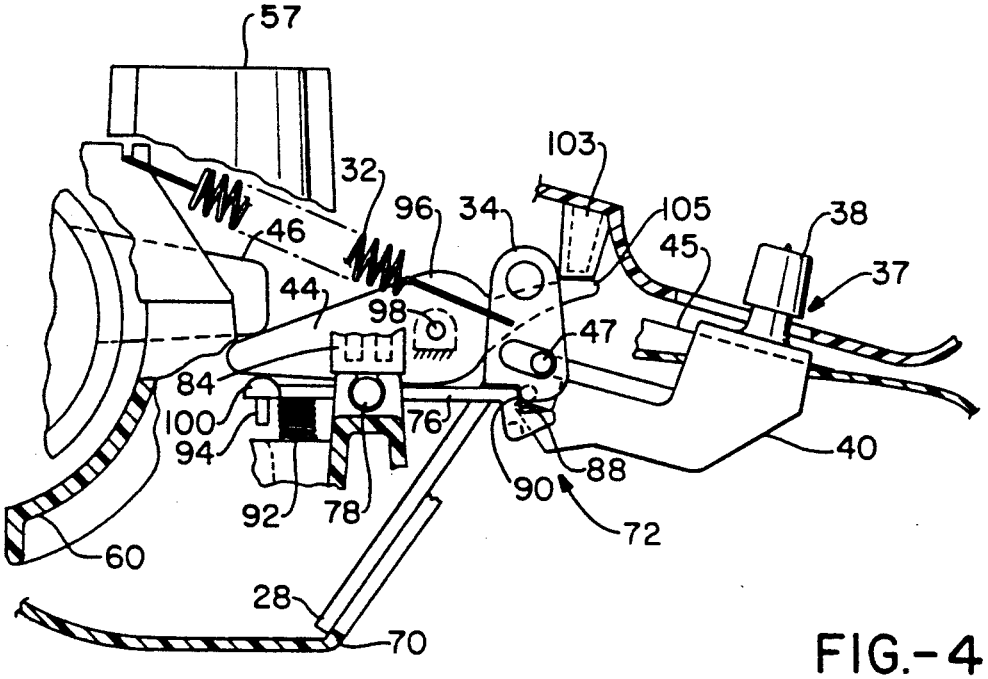
FIG. 4 is a similar view with the valve plate fully closed and latched in converted position by handle action.

Attention is now directed to FIGS. 3 and 4. In these two Figures, it can be seen that manual knob 38 of manual actuating means 37 has been physically moved forwardly (rightwardly) from the unconverted, open position of FIG. 1 towards the converted position FIG. 3) and then to closed, converted position (FIG. 4) against the urging of tension spring 32. This knob movement moves pin 47 forwardly, forcing valve cam link 34 to swing counterclockwise against the urging of tension spring 32. This movement of cam link 34 carries valve door 28 with it and, as the cam link pivots further and further counterclockwise, valve door 28 finally assumes converted position closing off suction duct 20. A stop 70 in this duct is positioned to prevent potential counterclockwise overswinging of valve door 28.

The manual knob 38 is guided in its movement by the projection 40 being generally U-shaped in elevation so that its legs 41, 41 (only one shown) ride over the duct 62 while its bight portion 43 is guided by an angled ramp 45. This ramp is mounted integral with the duct 20. The manual knob 38 can then easily translate along this ramp with its projection 40 being trapped beneath the cleaner hood.

In order to prevent reverse swinging of valve door 28 as urged by tension spring 32, a latching means 72 is provided which is urged into latching position by the hard bag handle 12 pivotally moving forwardly to upper, stored position as dictated by a hard bag pivot 73 FIG. 1) formed by its trundling arrangement (not shown). The tab 46, extending forwardly from hard bag trunnion portion 71 of hard bag handle 12, actuates a latching lever 76 to provide this action.

Latching lever 76 is pivotally mounted intermediate its ends by a transversely extending pintle 78 disposed in a cradle piece 80. The cradle piece has two pairs of upstanding arms 82, 82 (only one pair shown) which are transversely spaced to receive the opposite ends of the pintle 78. The cradle piece 80 is fixedly attached to the main nozzle body to positively locate it and the pintle 78 is positively located in it by an inwardly disposed, depending post 84 on duct cap 56.

Latching lever 76 includes adjacent its forward end an offset portion 86 that provides a latching nose 88 which is engageable in a rearward latching notch 90 in valve cam link 34 when the latching lever 76 is pivoted to this position with the valve door 28 in converted position. To prevent inadvertent latching, a compression spring 92, acting between the bottom casting 60 of the main nozzle body 14 and the rearward end of latching lever 76 always urges latching lever 76 into an unlatched, clockwise condition (FIG. 2 or 3) pivoted away from engagement of its latching nose with latching notch 90 of valve cam link 34. An integral rib 94 on this end of latching lever 76 strengthens its cantilever extent.

In order to swing latching lever 76 against the action of its compression spring 92, into latching position, a contacting pivoted urging tab 96 is pivotally mounted to a conventional wheeled undercarriage or the like (partially shown dashed of the vacuum cleaner 10 by a pivot pin 98. This pivot is disposed intermediate the tab ends. The contacting, pivoted urging tab 96 is disposed immediately above and aligned with the latching lever 76 so that counterclockwise pivoting of contacting tab 96 around pivot pin 98 causes it to abuttingly engage with a headed end 100 of rib 94 to thereby contact latching lever 76. This also urges it counterclockwise to place its nose 88 into position for latching.

This latching condition is then accomplished easily and positively by prior movement of the hard bag handle 12 into upper, storage (forward position) since the fixed tab 46 on it is also aligned with pivoted contacting tab 96. It abuttingly engages it during its forward, clockwise motion and thereby pivots it counterclockwise to provide positive engagement between latching nose 88 of latching lever 76 and latching notch 90 of valve cam link 34.

The counterclockwise swinging movement of pivoting contacting tab 96 also lifts main body 14 through nozzle hood 23 by contact by it with a nozzle hood post 103. This is accomplished by a forward, finger end 105 of pivoted contacting tab 96. By this arrangement, then, a positive latching condition is maintained while, at the same time, the main nozzle body 14 is raised to move its agitator (not shown) off the floor surface on which the vacuum cleaner 10 is situated.

The latching function just described may be obtained in a somewhat unwieldly manner from the user's standpoint by holding the conversion valve 30 closed against its spring and then manually moving the handle 12 to its upright latching position but, normally, the handle 12 is first placed in upright, stored position, and then conversion occasioned. In the normal case, however, the handle latching bar 42 must be overridden to place the unconverted valve 30 in converted, closed position, since the hard bag 12 is in its upper storage latching position.

As shown in FIG. 5, the hard bag-handle mounted tab 46 has been rotated clockwise from its non-abutting position to be situated in contacting position with pivoted, contacting tab 96. This forces latching lever 76 counterclockwise, through engagement of headed end 100 of stop pin 94 with pivoted contacting tab 96. A guide pin 102, near but slightly behind the latching nose 88 and mounted on latching lever 76, limits swinging of this lever by engaging in a relatively flat apex section 104 on another and lower arm 106 on fixed projection 40. It also extends rearwardly from the knob 38 which is, at this point, still in unconverted position. This arm is spaced transversely inwardly from upper arm 48 so as to provide clearance for the moving parts.

To place the valve door 28 in closed, converted position the manual knob 38 is grasped and moved forwardly (rightwardly—FIG. 6). The pin 102 remains in a nontranslatory fore and aft state, but an arcuate cam surface 108 on valve cam link 34 and located rearwardly from the pin 102 moves in a rotary sliding motion rearwardly along the latching lever 76 until the pin 102 clears the upper surface 109 on the latching lever 76 to again assume its latching position (FIG. 4) with its latching nose 88 engaged with latching notch 90 on cam link 34. Most of the parts in this conversion valve structure are made of plastic so that the illustrated deformation required of the plastic latching lever 76, as the cam surface 108 moves over the upper surface of the latching lever 76, is easily accommodated.

Independent of the method of latching, unlatching is normally occasioned by return of the hard bag handle 12 to its rearwardly positioning The conversion valve 30 then moves from its converted position illustrated in FIG. 4 to its intermediate position illustrated in FIG. 3 to its fully unconverted position in FIG. 2. As can be seen, rearward movement of handle 12 moves latching nose 88 of latching lever 76 clockwise, as urged by compression spring 92, to disengage it from latching notch 90 of valve cam link 34. As the fixed tab 46 attached to rearwardly moving handle 12 clears headed end 100 of latching lever 76, valve cam link 34 and its attached valve door 28 swing counterclockwise to valve door open position since there is no longer any resistance to valve cam link movement by tension spring 32. This movement of the valve cam link also places manual knob 38 in the rearward, unconverted position through the urging of pin 47 on knob projection 40.

The latching arrangement for conversion can also be overridden in reverse for unlatching. In the event that the hard bag handle 12 is in upper, storage position and the conversion valve 30 is in converted, closed position and it is desired to place the vacuum cleaner 10 in an unconverted state, the latching means 72 may be overridden. Guide pin 102 is in its upper limiting position (FIG. 4) as previously described with the handle upright and the valve door 28 latched. It may be easily cammed downwardly by rearward movement of the manual knob 38 from its unconverted position by its engagement with a second angled camming surface 110 on lower arm 106. This cam surface forms a leading edge for the lower arm 106 and, as it moves rearwardly, forces pin 102 downwardly to again deform locking lever 76. This finally moves pin 102 to cam surface 108 which trails cam surface 110 until the arm 106 has moved sufficiently rearwardly so that pin 102 can nest in apex 104 of lower arm 106. At this time, latching nose 88 and latching notch 90 are disengaged so that the vacuum cleaner 10 is in fully open, floor mode position.

It should be clear from the foregoing description that all the advantages set out at the beginning portion of the Specification have been met by the described structure. It should be also clear that many modifications could be made to this structure which would come within its spirit and purview.

What is claimed is:

1. A conversion valve arrangement for use with an upright vacuum cleaner having a manipulating push-pull handle pivotally attached to a main nozzle body comprising;

a) a valve door in a suction duct leading to the main nozzle entrance, said valve door movable between open and closed positions, b) manually operated means embodied within said main nozzle body for moving said valve door to at least one of its positions, c) latching means engageable with said movable valve door for latching said valve door in at least one of its positions, said latch means having an engaging position whereby said latch means engages said valve door and a non engageable position whereby said latch means does not engage said valve door, and d) said handle including actuating means for moving said latching means into said engaging position.

2. The upright cleaner of claim 1 wherein;

a) said valve door includes a first retention member, and b) said latching means includes a second retention member engageable with said first retention member, said actuating means urging said second retention member into position for engagement with said first retention member upon a selected movement of said handle.

3. The upright cleaner of claim 2 wherein;

a) said first retention member includes at least one cam surface for cammingly engaging said second retention member.

4. The upright cleaner of claim 2 wherein;

a) said first and second retention members are engageable only when said handle is in the upright position.

5. The upright cleaner of claim 1 wherein;

a) said valve door includes a pivoted valve door disposed in said suction duct, and pivoted between said open and closed, positions, b) said valve door including a latching tang affixed thereto, c) said latching means including a locking lever pivoted to said upright cleaner body, d) urging means for abutting said pivoted locking lever, and e) said urging means moved by said pivoted handle to move said latching means towards engagement with said valve door latching tang.

6. The upright cleaner of claim 5 wherein;

a) said latching tang and said latching means are engaged only when said valve door is in the closed position.

7. The upright cleaner of claim 5 wherein;

a) said urging means includes a fixed tab on said handle and a tab pivoted on said main body and engageable with said latching means.

8. The conversion valve arrangement of claim 1 wherein;

a) said actuating means includes a pivoting tab pivotally mounted to the main nozzle body of said vacuum cleaner whereby said handle acts upon said pivoting tab and said tab acts upon said latching means.

9. The conversion valve arrangement of claim 1 wherein;

a) said manually operated means for moving said valve door includes a slot and pin connection wherein said slot is attached to said valve door and said manually operated means includes a pin for engagement with said slot for effecting movement of said valve door.

10. The conversion valve arrangement of claim 1 wherein;

a) said valve door includes a latching notch and said latching means includes a latching nose.

11. An upright vacuum cleaner comprising:

a) a main body having incorporated therewith a motor fan, said motor fan having an inlet and an outlet, b) a manipulative handle, said handle including attachment means for pivotally attaching said handle to said main body, said handle having an upright stored position, c) said main body including a first suction conduit fluidly communicating between said fan inlet and a floor cleaning nozzle and a second suction conduit fluidly communicating between said fan inlet and an above the floor conversion hose, d) a latching lever pivotally connected to said main body, said latching lever having integral therewith, a latching nose, said latching lever and said latching nose movable about said pivotal connection between a first inoperable position and a second operable position, said latching lever being spring biased to said inoperable position, e) a movable valve door associated with said first suction conduit whereby the fluid path through said first suction conduit to said motor fan inlet may be selectively closed, said valve door including a notched camming surface whereby said camming surface cammingly engages and interlocks with the latching nose of said latching lever when said valve door is closed thereby locking said valve door in the closed position, f) means for selectively closing said movable valve door.

12. The vacuum cleaner claimed in claim 11 wherein said valve door is spring biased to the open position.

13. In an upright vacuum cleaner assembly comprising an ambulant main body, having a manipulating push-pull handle pivotally affixed to said main body and wherein said main body includes a primary floor cleaning mode and a converted above the floor cleaning mode, the improvement comprising:

a) a valve door for converting said vacuum cleaner from the floor cleaning mode to the above floor cleaning mode by selectively directing the working air through a floor cleaning nozzle or an above floor cleaning nozzle respectively, said valve door having a first unconverted floor cleaning position whereby said working air is directed through said floor cleaning nozzle, and a second, manually selectable, above floor converted cleaning position whereby said working air is directed through said above floor cleaning nozzle, said valve door biased to the unconverted position, b) manually operated means positioned on said main body for moving said valve door from the unconverted position to the converted position.

c) latching means for locking said valve door in the converted position, said latching means having a first inoperative and a second operative position whereby said latching means, when in said operative position, is configured to lockingly engage said valve door when said valve door is moved to the converted position thereby locking said valve door in the converted position, said latching means normally biased to said first inoperative position, d) latch actuation means including said push-pull handle whereby said latch actuation means cooperates with said latching means so as to move said latching means from said first inoperative position to said second operative position when said handle is placed in an upright position.

14. The upright cleaner of claim 13 wherein:

a) said valve door is a pivoted door.

15. The upright cleaner of claim 13 wherein;

a) said handle drives a pivoted tab member during its pivotal movement to the upright stored position, b) said pivoted tab thereby moving said latching means from said inoperative position to said operative position.

16. The upright cleaner of claim 13 wherein;

a) said handle also moves to permit said latching means to return to its inoperative position.

17. The upright cleaner of claim 16 wherein;

a) said handle moves said latch actuation means to the operative position when pivoted to its upright position, and b) said handle enables said latching means to return to the inoperative position when moved rearwardly from said upright position.

* * * * *